US007082798B2

(12) United States Patent
Schmauder et al.

(10) Patent No.: US 7,082,798 B2
(45) Date of Patent: Aug. 1, 2006

(54) PIPE BENDING MACHINE

(75) Inventors: Frank Schmauder, Metzingen (DE); Winfried Richter, Aichtal-Grötzingen (DE)

(73) Assignee: Trumpf Rohrtechnik GmbH + Co. KG, Reutlingen-Mittelstadt (DE)

( * ) Notice: Subject to any disclaimer, the term of this patent is extended or adjusted under 35 U.S.C. 154(b) by 368 days.

(21) Appl. No.: 10/618,245

(22) Filed: Jul. 11, 2003

(65) Prior Publication Data

US 2005/0016239 A1 Jan. 27, 2005

(30) Foreign Application Priority Data

Jul. 13, 2002 (EP) ..... 02015760

(51) Int. Cl.
*B21D 9/05* (2006.01)

(52) U.S. Cl. ..... 72/150; 72/149; 72/157

(58) Field of Classification Search ..... 72/149, 72/150, 157, 159, 217, 306, 307, 388
See application file for complete search history.

(56) References Cited

U.S. PATENT DOCUMENTS 4,625,531 A * 12/1986 Lafrasse et al. ..... 72/150
5,481,891 A 1/1996 Sabine
6,155,091 A * 12/2000 Hayes et al. ..... 72/150
6,345,525 B1 2/2002 Bruyas et al.

FOREIGN PATENT DOCUMENTS

DE 4010 445 A1 9/1991
WO WO 87/00096 1/1987

* cited by examiner

*Primary Examiner*—Jack Keith
*Assistant Examiner*—Hung C. Le

(57) ABSTRACT

A pipe bending machine (1) includes a bending tool (3), a pipe feed unit (9) and a mandrel retractor (19). A pipe holder (8) of the pipe feed unit (9) and a mandrel bar support (24) of the mandrel retractor (19) are guided in the longitudinal pipe direction (12) by a common linear guide system (16) on the machine base. Alternatively or in addition thereto the pipe holder (8) and the mandrel bar support (24) can be moved in the longitudinal pipe direction (12) by a common drive system (15) on the machine base.

10 Claims, 5 Drawing Sheets

PIPE BENDING MACHINE

BACKGROUND OF THE INVENTION

This invention relates to a pipe bending machine with a bending tool, a pipe feed by means of which a pipe that is to be bent can be advanced along its longitudinal axis towards the bending tool, a pipe holder that is guided in the longitudinal direction of the pipe in a linear guide unit provided on the machine base and movable by a pipe feed drive system with a drive mechanism mounted on the machine base, and a mandrel retractor by which a bending mandrel mounted on a mandrel bar that extends in the longitudinal direction of the pipe on the bending tool side can be moved back and forth in the axial direction of the pipe between a working position and a retracted position. The mandrel retraction device includes a mandrel bar support that is guided in the longitudinal direction of the pipe by a linear guide unit provided on the machine base and can be moved by means of a mandrel bar drive unit operated by a drive system located on the machine base.

A pipe bending machine of this type is known and has been described in DE-A-40 10 445. In this prior art system, the pipe to be bent is clamped between a bending template and the clamping jaw of a bending tool and is then shaped by turning the bending template and rotating the clamping jaw around a bending axis. The pipe is advanced relative to the bending tool by means of a pipe feed with a feed carriage that can be moved in the longitudinal direction of the pipe. The carriage is equipped with a clamping sleeve that holds the pipe at its far end spaced from the bending tool. The feed carriage of this prior art pipe bending machine is moved in the longitudinal direction of the pipe by a toothed belt driven by a motor mounted on the machine base. In the direction of its linear travel, the feed carriage is guided by guide rollers that are themselves controlled by a longitudinal guide on the machine base.

A bending mandrel that, when in its working position next to the bending tool, is inserted in the pipe to be bent, making certain that during the bending process the cross-sectional profile of the pipe is not deformed. Just before a bending process is completed, the bending mandrel is pulled back from its working position into a retracted position and thus moved away from the bending tool. The bending mandrel is mounted at the end of a mandrel bar that extends on the bending-tool side in the longitudinal direction of the pipe. The mandrel bar extends through the entire feed carriage of the pipe feed unit and is held in place in a mounting on the side of the latter facing away from the bending tool. For moving the bending mandrel, the mounting with the mandrel bar retained by it travels in the longitudinal direction of the pipe under the action of a piston and cylinder assembly attached to the machine base.

To move the feed carriage and the bending mandrel, this prior art design is relatively complex. Moreover, the movement of the mandrel bar mount in the longitudinal direction of the pipe is spatially very restricted.

It is therefore the objective of this invention to improve the prior art design by providing a novel bending pipe machine with a common linear guide system and/or common drive system for the mandrel bar support and pipe holder.

SUMMARY OF THE INVENTION

It has now been found that the foregoing and related objects may be readily attained in a pipe bending machine comprising a machine base (2), a bending tool (3) mounted on the machine base (2), and a pipe feed unit (9) on the machine base (2) by which a pipe (6, 6*a*) to be bent can be advanced to the bending tool (3) in the longitudinal direction (12) of the pipe. The pipe feed unit includes a pipe holder (8) that is guided in the longitudinal pipe direction (12) by a linear guide system (16) on the machine base (2) and a pipe feed driven by a drive system (15) provided on the machine base.

A mandrel bar (20, 20*a*) extending in the longitudinal direction of the pipe (6), and a mandrel retractor (19) on the machine base (2) with a bending mandrel (21) mounted at the bending tool end of the mandrel bar (20, 20*a*) can be moved back and forth between a working position. The mandrel retractor (19) includes a mandrel bar support (24) which in the longitudinal pipe direction (12) is guided by a linear guide system (16) on the machine base and can be moved by a mandrel bar drive operated by a drive system (15) on the machine base (2). The mandrel bar support (24) and the pipe holder (8) are movable by one common linear guide system (16) on the machine base and/or one common drive system (15) on the machine base.

Preferably, the pipe bending machine has a common linear guide system (16) for the mandrel bar support (24) and pipe holder (8) with at least one guide rail (17). The mandrel bar drive and the pipe feed drive employ rack-and-pinion drives, and the common drive system (15) on the machine base for moving the mandrel bar support (24) and pipe holder (8) includes at least one rack that meshes with at least one pinion (26) on the mandrel bar support and with at least one pinion (14) on the pipe holder.

Desirably, the mandrel bar support (24) and the pipe holder (8) are respectively attached to a carriage (23, 10) or slide guided by a common linear guide system (16) on the machine base and/or driven by the common drive system (15) on the machine base. The mandrel bar support (24) is driven by means of a mandrel bar drive including at least one electric motor (22) on the mandrel bar.

Generally, the mandrel bar support (24) and the pipe holder pipe holder (8) is driven by means of a pipe feed drive unit including at least one electric motor (11) on the pipe holder as part of a common drive system (15) on the machine base. The mandrel bar support (24) and the pipe holder (8) can be driven by means of a numerically controlled mandrel bar drive unit and a numerically controlled pipe feed drive unit as part of a common drive system (15) on the machine base. The mandrel bar (20, 20*a*) on the mandrel bar support (24) is interchangeable with others of different length.

As can be seen, the machine of the present invention provides a common linear guide system on the machine base and/or a common drive system for the mandrel bar support and pipe holder on the machine base. Due to the dual function of the guide and/or drive system, the design is simple in terms of components needed for moving the mandrel bar support and the pipe holder. Design simplicity is also obtainable in the pipe bending machine of this invention by using identical guide and/or drive system components for the mandrel bar support and pipe holder. Since the mandrel bar support can be operated by the linear guide system on the machine base and/or by the pipe-holder drive system on the machine base, the mandrel bar support can be moved in the longitudinal direction of the pipe over a substantial distance.

There is particularly advantageous since it allows for a flexible adaptation of the mandrel retraction to a wide range of varying pipe lengths to be processed. The pipe length determines in each case the point at which the pipe holder of the pipe feed system is positioned on the machine base in the longitudinal direction of the pipe at the beginning of the bending process. That initial position of the pipe holder in turn determines the position of the mandrel bar support in the longitudinal direction of the pipe. Even in the case of major pipe length variations, the mandrel bar support in the pipe bending machine can follow the pipe holder as it is moved into its various initial positions. When short pipes are to be bent, the initial position of the pipe holder and that of the mandrel bar support will be correspondingly close to the bending tool. Accordingly, in pipe bending machines of this invention, a short mandrel bar, conceivably designed for easy manipulation is sufficient for mandrel retraction. If long pipes are to be bent, the pipe holder in its initial position and the mandrel bar support will be located at a correspondingly greater distance from the bending tool, for which purpose a long mandrel bar must be used.

BRIEF DESCRIPTION OF THE DRAWINGS

The following will explain this invention in more detail by way of an implementation example and with reference to the attached drawings in which.

DETAILED DESCRIPTION OF THE ILLUSTRATED EMBODIMENT

Figure 1:
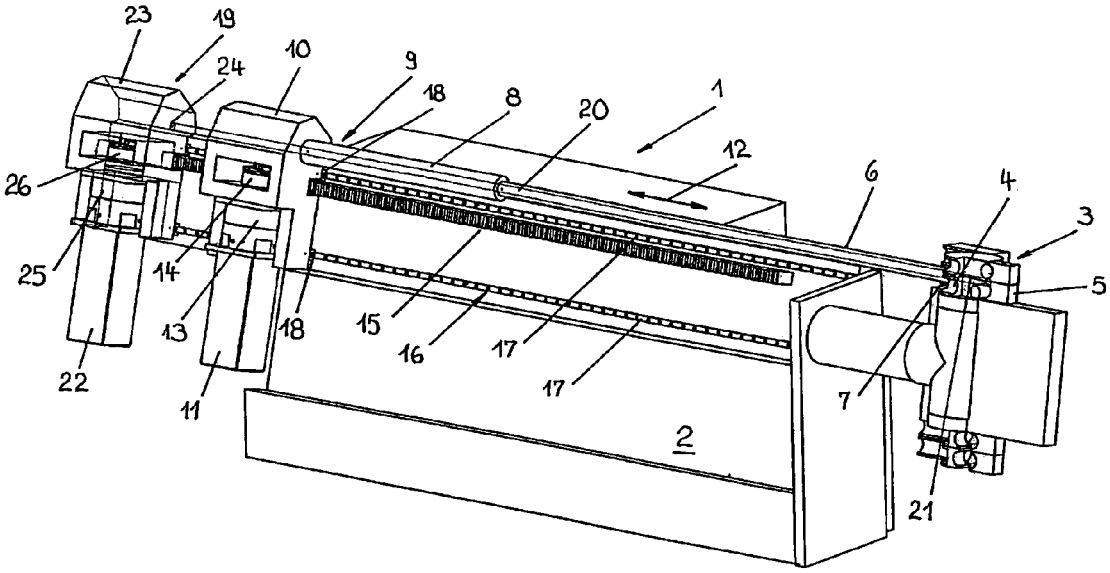
FIG. 1 is a perspective illustration of a pipe bending machine embodying the present invention in the initial phase of processing a long pipe.

As shown in FIG. 1, a pipe bending machine generally designated by the numeral 1 includes a machine base 2 equipped at one longitudinal end with a bending tool generally designated by the numeral 3. The bending tool 3 is a conventional, torsional bending tool suitable for left and right bending as well as for multi-plane bending. Other types of bending tools may be used in lieu of the bending tool illustrated.

In the operating state shown, a bending template 4 and a clamping jaw 5 of the bending tool 3 are clamping the forward end of a pipe 6 which has already been bent. A slide rail 7 of the bending tool 3 serves in traditional fashion for the radial support of the pipe 6 in the region in which the unbent pipe section transitions into the bent pipe section. Instead of a pipe 6 with a circular cross section as shown, the pipe bending machine 1, when equipped with an appropriate bending tool 3, can also process tubular profiles with a noncircular cross section.

The far end of the pipe 6 spaced from the bending tool 3 is clamped in a pipe holder 8 in the form of a conventional chuck. The pipe holder 8 is part of a pipe feed unit 9 and as such it is positioned on a carriage 10 of the pipe feed unit 9. An electric motor 11, flange-mounted on the carriage 10, serves to drive the carriage 10 and the pipe holder 8 along with the clamped pipe 6 in the longitudinal pipe direction 12. To that effect the electric motor 11, by a gear system 13, drives a pinion 14 that meshes with a rack serving as the drive system 15 on the machine base. The pipe holder 8 and thus the pipe 6, when moved in the longitudinal pipe direction 12, is guided on the machine base by a linear guide system 16 that encompasses two guide rails 17. Counterstays 18 on the carriage 10 cooperate with the guide rails 17.

Figure 2:
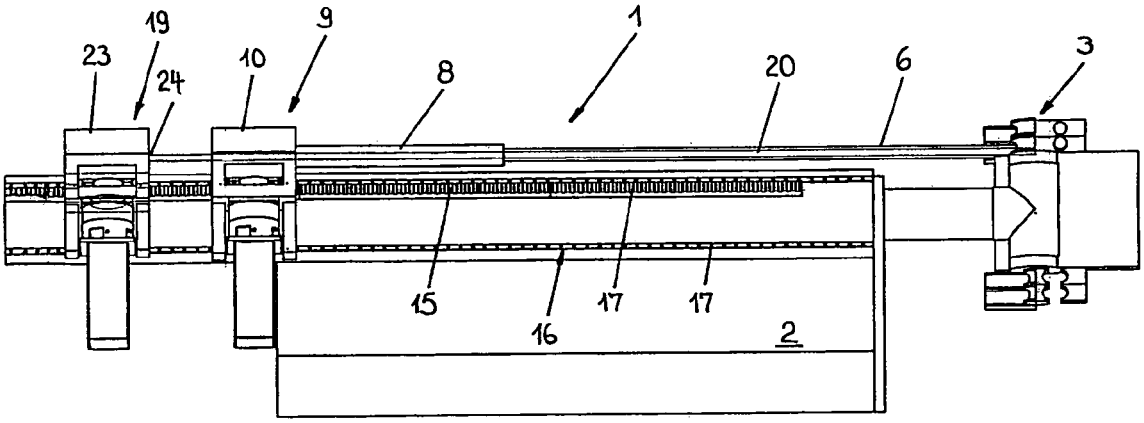
FIG. 2 is a side elevational view of the pipe bending machine of FIG. 1.
Figure 3:
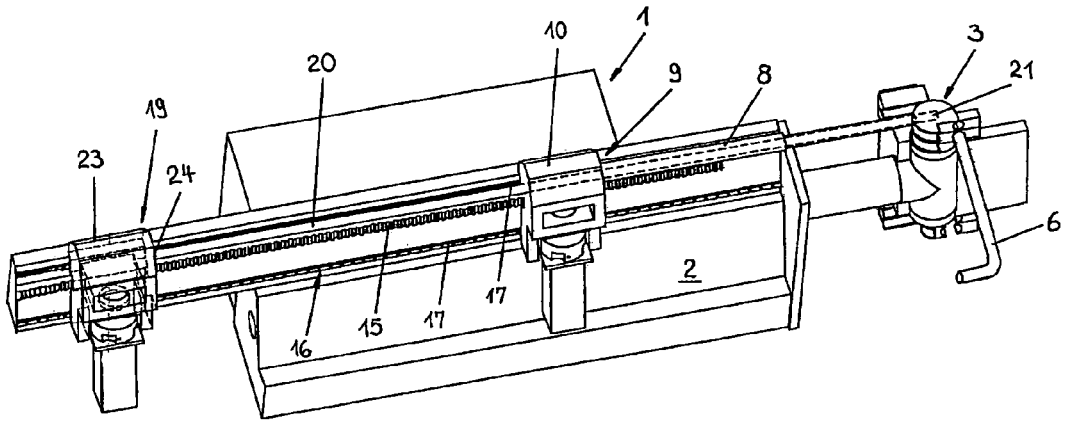
FIG. 3 shows the pipe bending machine of FIGS. 1 and 2 in an advanced processing phase of the long pipe.

A mandrel retractor 19 is configured similar to the pipe feed unit 9, and it encompasses a mandrel bar 20 that protrudes through the carriage 10 and the pipe holder of the pipe feed unit 9 into the inside of the pipe 6 and is equipped at its end facing the bending tool 3 with a bending mandrel 21. During the bending process, the bending mandrel 21 is in its normal working position near the bending tool 3 as illustrated in FIGS. 1 to 3, thus preventing any undesirable cross-sectional deformation of the pipe in the area of the pipe curvature being produced. Just prior to completion of the bending process, movement of the mandrel bar 20 retracts the bending mandrel 21 from its working position in the longitudinal pipe direction 12.

The necessary linear movement of the mandrel bar 20 is effected by an electric motor 22 that is flange-mounted on a carriage 23 of the mandrel retractor 19. The carriage 23 is provided with a mandrel bar support 24 on which the far end of the mandrel bar 20 spaced from the bending tool 3 is detachably mounted. By way of a gear system 25 the electric motor 22 drives a pinion 26. As in the case of the pinion 14 of the pipe feed unit 9, the pinion 26 of the mandrel retractor 19 meshes with a drive system 15 provided by the rack on the machine base 2. The carriage 23 of the mandrel retractor 19 is again guided in the longitudinal pipe direction 12 by the guide rails 17 of the linear guide system 16 on the machine base. The pipe feed unit 9 and the mandrel bar retractor 19 are CNC-controlled. The carriages 10, 23 can be moved in mutually disengaged fashion. In lieu of the rack drive shown, other drive configurations may be used, especially those with a drive rod on the machine base and/or with drive wheels on the carriages 10, 23.

Prior to the bending operation and with the bending tool 3 in its open initial position, the as yet unprocessed pipe 6 is slipped onto the mandrel bar 20 in the longitudinal pipe direction 12 and its rearward end is clamped onto the pipe holder 8. At this juncture the bending mandrel 21 may already be in its working position.

After the pipe 6 is clamped onto the pipe holder 8, the carriage 10 with pipe 6 is moved in the longitudinal pipe direction 12 and into the desired position. The bending tool 3 is then closed and the pipe 6 is clamped between the bending template 4 and the clamping jaw 5. The pipe bend shown in FIGS. 1 and 2 is produced by the subsequent torsional and rotational movement of the bending template 4 and of the clamping jaw 5. Just before the bending process is completed, the bending mandrel 21 is moved into a retracted position. FIGS. 1 to 3 depict the operating state just prior to this pull-back movement of the bending mandrel 21. For the retraction of the bending mandrel 21, the carriage 23 of the mandrel retractor 19 with its attached mandrel bar 20 is correspondingly moved in the longitudinal pipe direction 12.

To continue the process, the next step is to open the bending tool 3 in its initial state and then to advance the pipe 6 relative to the bending tool 3 by moving the pipe feed unit 9 in the longitudinal pipe direction 12. That places the carriage 10 and the pipe holder 8 in the position illustrated in FIG. 3. An appropriate movement of the carriage 23 with the mandrel bar support 24 and the mandrel bar 20 toward the bending tool 3 will place the bending mandrel 21 in its working position shown in FIG. 3. The bending tool 3 can then be closed and the pipe 6 can be processed as shown in FIG. 3.

Figure 4:
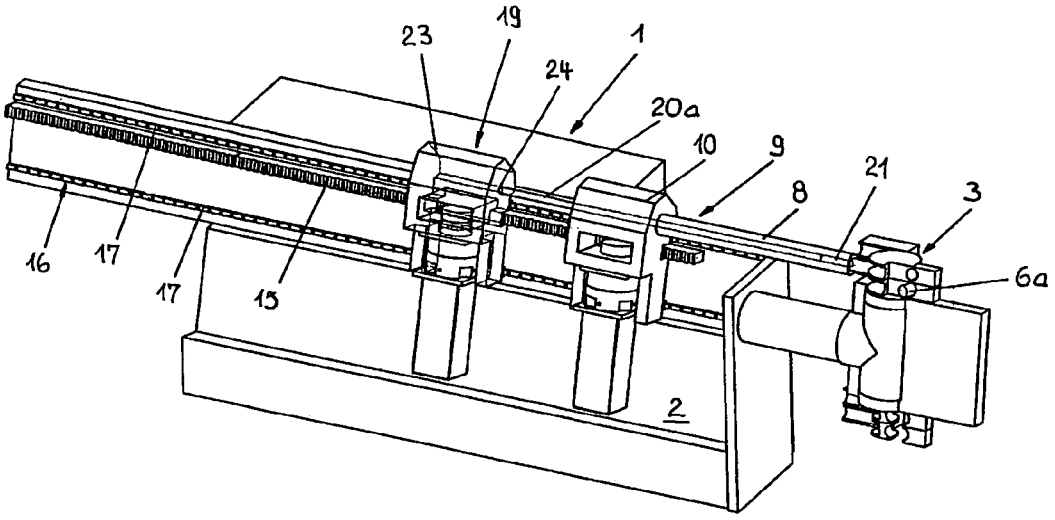
FIG. 4 is a perspective view of the pipe bending machine of FIG. 1 in the initial phase of processing a short pipe.
Figure 5:
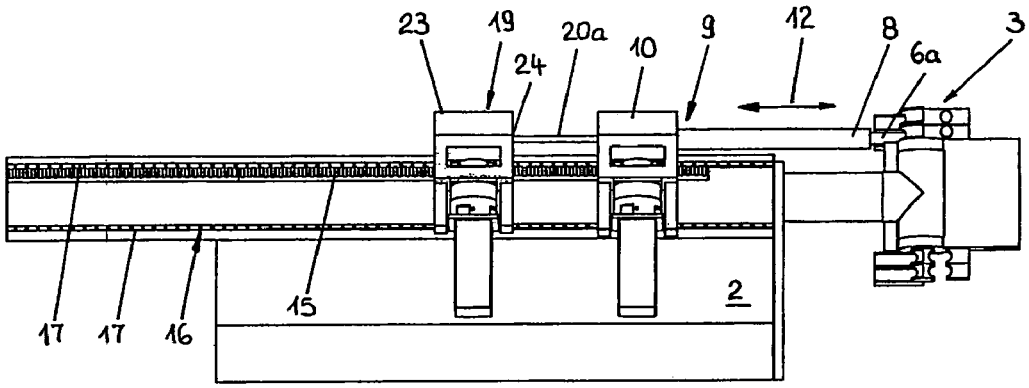
FIG. 5 is a side elevational view of the pipe bending machine of FIG. 4.

If, instead of a long pipe 6 as shown in FIGS. 1 to 3, a short pipe 6*a* is to be processed as shown in FIGS. 4 and 5, a short mandrel bar 20*a* shown in FIGS. 4 and 5 is used in the pipe bending machine 1 in place of the long mandrel bar 20 shown in FIGS. 1 to 3. To that effect the long mandrel bar 20 on the mandrel bar support 24 can be replaced with a short mandrel bar 20*a*. When the pipe 6*a* is to be processed, the carriage 10 with the pipe holder 8 will be close to the end of the machine base 2 on the side of the bending tool 3. The carriage 23 with its attached mandrel bar 20*a* follows the carriage 10 of the pipe feed unit 9 into a position near the bending tool 3. In the process, both the carriage 23 of the mandrel retractor 19 and the carriage 10 of the pipe feed unit 9 are guided by the guide rails 17 of the linear guide system 16 on the machine base. Both the pinion 26 of the mandrel retractor 19 and the pinion 14 of the pipe feed unit 9 mesh with the rack, i.e., with the drive system 15, on the machine base. The processing of the short pipe 6*a* illustrated in FIGS. 4 and 5 follows the same steps as described in detail for the long pipe 6 with reference to FIGS. 1 to 3. FIGS. 4 and 5 show the bending mandrel 21 in its retracted position.

Thus, it can be seen from the foregoing detailed description and attached drawings that the bending machine provides a novel common drive or guide system for the pipe holder and mandrel bar support. This provides for economical construction and efficient operation.

Having thus described the invention, what is claimed is:

1. A pipe bending machine comprising:

(a) a machine base (2);

(b) a bending tool (3) mounted on the machine base (2);

(c) a pipe feed unit (9) on the machine base (2) by which an elongated defining pipe (6. 6*a*) to be bent and defining a longitudinal direction can be advanced to the bending tool (3) in the longitudinal direction (12) of the pipe, the pipe feed unit including a pipe holder (8) that is guided in the longitudinal direction (12) of the pipe by a linear guide system (16) on the machine base (2) and a pipe feed driven by a drive system (15) provided on the machine base;

(d) a mandrel bar (20,20*a*) extending in the longitudinal direction of the pipe (6); and (e) a mandrel retractor (19) on the machine base (2) with a bending mandrel (21) mounted at the end of the mandrel bar (20, 20*a*) adjacent the bending tool can be moved back and forth between a working position and a retracted position, said mandrel retractor (19) including a mandrel bar support (24) which in the longitudinal direction (12) of the pipe is guided by a linear guide system (16) on the machine base and can be moved by a mandrel bar drive operated by a drive system (15) on the machine base (2), the mandrel bar support (24) and the pipe holder (8) being movable by one of (i) a common linear guide system (16) on the machine base and (ii) a common drive system (15) on the machine base.

2. The pipe bending machine in accordance with claim 1 wherein a common linear guide system (16) for the mandrel bar support (24) and pipe holder (8) includes at least one guide rail (17).

3. The pipe bending machine in accordance with claim 1 wherein the mandrel bar drive and the pipe feed drive system employ rack-and-pinion drives and wherein the common drive system (15) on the machine base for moving the mandrel bar support (24) and pipe bolder (8) includes at least one rack that meshes with at least one pinion (26) on the mandrel bar support and with at least one pinion (14) on the pipe holder.

4. The pipe bending machine in accordance with claim 1 wherein the mandrel bar support (24) and the pipe holder (8) are respectively attached to one of (i) a carriage (23, 10) and (ii) a slide guided by a common linear guide system (16) on the machine base and driven by the common drive system (15) on the machine base.

5. The pipe bending machine in accordance with claim 1 wherein the mandrel bar support (24) is driven by means of a mandrel bar drive including at least one electric motor (22) on the mandrel bar.

6. The pipe beading machine in accordance with claim 1 wherein the mandrel bar support (24) and the pipe holder pipe holder (8) is driven by means of a pipe feed drive unit including at least one electric motor (11) on the pipe holder as part of a common drive system (15) on the machine base.

7. The pipe bending machine in accordance with claim 1 wherein the mandrel bar support (24) and the pipe holder (8) can be driven by means of a numerically controlled mandrel bar drive unit and a numerically controlled pipe feed drive unit as part of a common drive system (15) on the machine base.

8. The pipe bending machine in accordance with claim 1 wherein the mandrel bar (20, 20*a*) on the mandrel bar support (24) is interchangeable.

9. A pipe bending machine comprising:

(a) a machine base (2);

(b) a bending tool (3) mounted on the machine base (2);

(c) a pipe feed unit (9) on the machine base (2) by which an elongated pipe (6,6*a*) to be bent and defining a longitudinal direction can be advanced to the bending tool (3) in the longitudinal direction (12) of the pipe, the pipe feed unit including a pipe holder (8) that is guided in the longitudinal direction (12) of the pipe by a linear guide system (16) on the machine base (2) and a pipe feed driven by a drive system (15) provided on the machine base;

(d) a mandrel bar (20,20*a*) extending in the longitudinal direction of the pipe (6);

(e) a mandrel retractor (19) on the machine base (2) with a bending mandrel (21) mounted at the end of the mandrel bar (20, 20*a*) adjacent the bending tool can be moved back and forth between a working position and a retracted position, said mandrel retractor (19) including a mandrel bar support (24) which in the longitudinal direction (12) of the pipe is guided by a linear guide system (16) on the machine base and can be moved by a mandrel bar drive operated by a drive system (15) on the machine base (2), the mandrel bar support (24) and the pipe holder (8) being movable by one of a (i) common linear guide system (16) on the machine base and (ii) one common drive system (15) on the machine base, said common linear guide system (16) for the mandrel bar support (24) and pipe holder (8) includes at least one guide rail (17), said mandrel bar drive and the pipe feed chive employing rack-and-pinion drives, said common drive system (15) on the machine base for moving the mandrel bar support (24) and pipe holder (8) includes at least one rack that meshes with at least one pinion (26) on the mandrel bar support and with at least one pinion (14) on the pipe holder, and wherein said mantel bar support (24) and the pipe holder (8) can be driven by means of a numerically controlled mandrel bar drive unit and a numerically controlled pipe feed drive unit as part of a common drive system (15) on the machine base.

10. The pipe bending machine in accordance with claim 9 wherein the mandrel bar support (24) and the pipe holder (8) are respectively attached to one of (i) a carriage (23, 10) and (ii) a slide guided by a common linear guide system (16) on the machine base and driven by the common drive system (15) on the machine base.

* * * * *

UNITED STATES PATENT AND TRADEMARK OFFICE

CERTIFICATE OF CORRECTION

PATENT NO. : 7,082,798 B2
APPLICATION NO. : 10/618245
DATED : August 1, 2006
INVENTOR(S) : Frank Schmauder and Winfried Richter It is certified that error appears in the above-identified patent and that said Letters Patent is hereby corrected as shown below:

Column 6, line 49, "chive" should be --drive--

Signed and Sealed this

Fourteenth Day of November, 2006

JON W. DUDAS
*Director of the United States Patent and Trademark Office*